US006817752B2

(12) United States Patent
Tolle

(10) Patent No.: US 6,817,752 B2
(45) Date of Patent: Nov. 16, 2004

(54) AUGER DEVICE FOR A VERTICAL MIXER

(75) Inventor: Corey Tolle, Jesup, IA (US)

(73) Assignee: KuhnKnight INC, Brodhead, WI (US)

( * ) Notice: Subject to any disclaimer, the term of this patent is extended or adjusted under 35 U.S.C. 154(b) by 0 days.

(21) Appl. No.: 10/268,617

(22) Filed: Oct. 10, 2002

(65) Prior Publication Data

US 2004/0071045 A1 Apr. 15, 2004

(51) Int. Cl.[7] ..... B02C 18/08; B01F 7/24

(52) U.S. Cl. ..... 366/314; 366/318; 366/323; 366/603; 241/46.17; 241/46.017; 241/260.1

(58) Field of Search ..... 366/312, 314, 366/318, 323, 266, 603; 241/101.761, 46.17, 46.017, 260.1

(56) References Cited

U.S. PATENT DOCUMENTS 4,413,789 A * 11/1983 Rienecker et al. ..... 241/46.17
4,535,943 A * 8/1985 Couture ..... 241/46.17
4,607,802 A * 8/1986 Lamort ..... 241/46.017
4,725,007 A * 2/1988 Chupka ..... 241/46.17
4,949,916 A * 8/1990 Wroblewski ..... 241/260.1
5,082,188 A * 1/1992 Urich ..... 241/101.761
5,772,131 A * 6/1998 Dal Maso ..... 241/46.17
5,863,122 A * 1/1999 Tamminga ..... 366/314
6,328,465 B1 * 12/2001 Tamminga ..... 366/314

* cited by examiner

*Primary Examiner*—Tony G. Soohoo
(74) *Attorney, Agent, or Firm*—David J. Archer

(57) ABSTRACT

An auger device of a vertical mixer is disclosed for mixing animal feed. The auger device includes a core having a first and a second end and flighting which is secured to the core so that in operation of the mixer, when the auger device rotates, the animal feed is mixed. The flighting includes a first portion which is disposed helically around the core such that the feed is urged by the first portion in a direction from the first towards the second end of the core. Additionally, a second portion is disposed helically around the core such that the feed is urged by the second portion in the direction from the first towards the second end of the core. Also, the second portion is interposed between the first portion.

7 Claims, 4 Drawing Sheets

AUGER DEVICE FOR A VERTICAL MIXER

BACKGROUND OF THE INVENTION

1. Field of the Invention

The present invention relates to an auger device for a vertical mixer. More specifically, the present invention relates to an auger device of a vertical mixer for mixing animal feed.

2. Background Information

Vertical mixers are used particularly for mixing animal feed and the like. Cattle farming requires the mixing of various livestock feeds for subsequent distribution. Additionally, mixers can be used for mixing other materials such as composts and the like. Sometimes such mixing of feeds includes depositing at least one bale of hay into a mixer container together with other additives. The materials within the container are mixed by means of at least one auger which rotates within the container so that an intimate mixing of the contents of the container is obtained. Although many mixers employ a pair of horizontal interacting augers extending longitudinally along the container, several mixers have been proposed in which the auger or augers are disposed vertically.

In the prior art mixers of the vertical auger type, such mixers sometimes include a pair of augers in which the rotational axes of the augers are disposed spaced and parallel relative to each other. Also, some vertical mixers have a single auger. However, for a particular rotational speed of a vertical auger, the amount of feed conveyed from the bottom to the top of the auger will to a large degree depend on how much feed is swept or gathered into the spiral flighting of the auger at the bottom of the auger and the vertical distance between adjacent convolutions of the helical flighting. For example, if such distance between adjacent convolutions is relatively small for a given overall height of the auger, the feed will take a relatively long time to travel from the bottom to the top of the auger. Conversely, if the distance between adjacent convolutions is greater, that is, the pitch of the helical flighting is coarse, the feed will rapidly move upwards from the bottom to the top of the auger. However, in the later case, greater horsepower is required to convey the feed. Furthermore, with a coarse pitch of the flighting, there is a tendency for less feed to be carried between adjacent convolutions of the flighting due to the inability of the lower end or leading edge of the flighting to fully load feed into such space or void between adjacent convolutions.

The present invention overcomes the aforementioned problems associated with a relatively coarse pitch auger flighting by the provision of an auger having twin flightings in which each convolution of one helical or spiral flighting is disposed adjacent to a corresponding convolution of a second helical flighting. In this manner, the overall pitch of the combined flightings is relatively fine so that the vertical distance between adjacent convolutions is relatively small. This means that feed can easily be loaded into and fill the void between such adjacent convolutions.

Furthermore, by the provision of twin interacting helical flightings, two leading edges are defined by the lower edges of the respective flightings. Thus, such leading edges, are able, while sweeping the floor of the mixer, to gather into the spiral conveyor approximately twice as much feed as is the case with a single flighting which has only one leading edge. Therefore, for a small increase in horsepower, the auger device according to the present invention is able to convey almost twice the amount of feed thus decreasing the time taken to accomplish a mixing operation.

Therefore, it is a primary feature of the present invention to provide an auger device of a vertical mixer that overcomes the problems associated with the prior art arrangements.

Another feature of the present invention is the provision of an auger device of a vertical mixer that decreases the time required to complete a mixing operation.

Other features and advantages of the present invention will be readily apparent to those skilled in the art by a consideration of the detailed description of a preferred embodiment of the present invention contained herein.

SUMMARY OF THE INVENTION

The present invention relates to an auger device of a vertical mixer for mixing animal feed. In a first aspect of the present invention, the auger device includes a core having a first and a second end and flighting which is secured to the core so that in operation of the mixer, when the auger device rotates, the animal feed is mixed. The flighting includes a first portion which is disposed helically around the core such that the feed is urged by the first portion in a direction from the first towards the second end of the core. Additionally, a second portion is disposed helically around the core such that the feed is urged by the second portion in the direction from the first towards the second end of the core. Also, the second portion is interposed between the first portion.

In a second aspect of the present invention, the auger device includes a core having a first and a second end and flighting which is secured to the core so that in operation of the mixer, when the auger device rotates, the animal feed is mixed. The flighting includes a first portion which is disposed helically around the core such that the first portion defines a first convolution. The first portion also includes at least a part of a second convolution which is disposed consecutively relative to the first convolution so that when the core rotates, the feed is urged by the first portion in a direction from the first towards the second end of the core. Additionally, the flighting includes a second portion which is disposed helically around the core such that the second portion defines a third convolution and at least a part of a fourth convolution which is disposed consecutively relative to the third convolution so that when the core rotates, the feed is urged by the second portion in the direction from the first towards the second end of the core. Also, the third convolution is disposed between the first and the at least part of the second convolution.

In a third aspect of the present invention, the auger device includes a core having a first and a second end. Flighting is secured to the core so that in operation of the mixer, when the auger rotates, the animal feed is mixed. The flighting includes a first portion which is disposed helically around the core such that the first portion defines a first convolution and a second convolution which is disposed consecutively relative to the first convolution so that when the core rotates, the feed is urged by the first portion in a direction from the first towards the second end of the core. A second portion is disposed helically around the core such that the second portion defines a third convolution and a fourth convolution is disposed consecutively relative to the third convolution so that when the core rotates, the feed is urged by the second portion in the direction from the first towards the second end of the core. Also, the third convolution is disposed between the first and second convolutions.

In a more specific embodiment of the present invention, the core rotates about a vertical axis and is of cylindrical configuration.

The auger device also includes a floor which is disposed adjacent to the first end of the core, the core being rotatable relative to the floor so that in use of the vertical mixer, the core rotates about a vertical axis extending normal to the floor.

Additionally, the first portion has a first and a second termination, the first termination interacting with the floor such that when the core rotates relative to the floor, the first termination of the first portion sweeps the feed from the floor in the direction towards the second end of the core.

Moreover, the second portion has a first and a second extremity, the first extremity interacting with the floor such that when the core rotates relative to the floor, the first extremity of the second portion sweeps the feed from the floor in the direction towards the second end of the core.

Also, the first termination of the first portion and the first extremity of the second portion are spaced circumferentially about the vertical axis of the core.

More particularly, the first termination of the first portion and the first extremity of the second portion are spaced diametrically opposite to each other about the vertical axis of the core.

Furthermore, in a preferred embodiment of the present invention, the second convolution follows immediately after the first convolution in the direction from the first towards the second end of the core.

Additionally, the fourth convolution follows immediately after the third convolution in the direction from the first towards the second end of the core.

The arrangement is such that the convolutions taken in the direction from the first termination of the first portion follow a sequence of the first convolution to the third convolution, the third convolution to the second convolution, the second convolution to the fourth convolution so that the convolutions of the second portion are interposed between the convolutions of the first portion.

In the preferred embodiment of the present invention, the first portion is disposed helically around the core such that the first portion defines a first convolution and a second convolution disposed successively relative to the first convolution so that when the core rotates, the feed is urged by the first portion in a direction from the first towards the second end of the core.

Moreover, the second portion is disposed helically around the core such that the second portion defines a third convolution and a fourth convolution disposed successively relative to the third convolution so that when the core rotates, the feed is urged by the second portion in the direction from the first towards the second end of the core.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

In the present application, the term "convolution" is to be understood as meaning one turn of the helical flighting through 360 degrees. Also, the term "consecutive" is to be understood as meaning having a logical sequence. Furthermore, successive is to be understood as meaning following immediately one after the other. The aforementioned understanding is generally the same as the meaning set forth in Webster's Dictionary 1989 edition in which convolution is defined as "one turn of a coil or spiral", consecutive is defined as "marked by logical sequence" and successive is defined as "following one immediately after another".

BRIEF DESCRIPTION OF THE DRAWINGS

Similar reference characters refer to similar parts throughout the various views of the drawings.

DETAILED DESCRIPTION OF THE DRAWINGS

Figure 1:
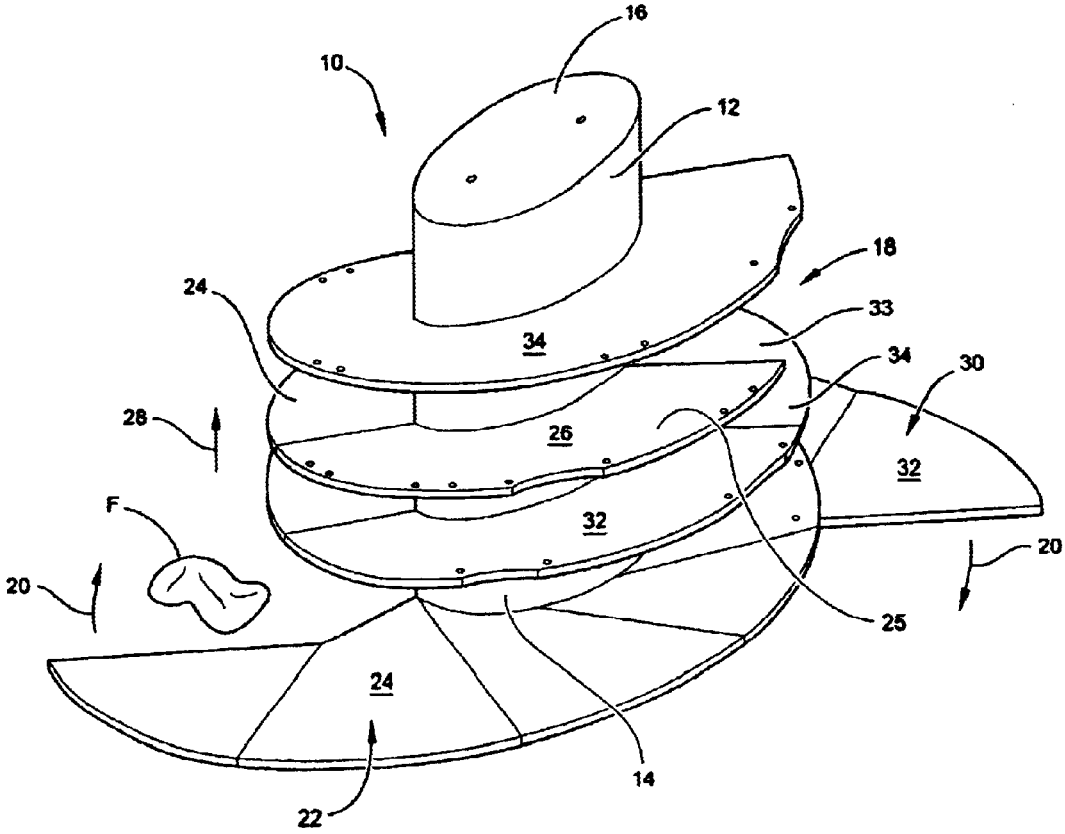
FIG. 1 is a perspective view of an auger device of a vertical mixer according to a first and second aspect of the present invention for mixing animal feed.

FIG. 1 is a perspective view of an auger device of a vertical mixer according to a first aspect of the present invention for mixing animal feed. As shown in FIG. 1, the auger device generally designated 10 includes a core 12 having a first and a second end 14 and 16 respectively and flighting generally designated 18 which is secured to the core 12 so that in operation of the mixer, when the auger device 10 rotates, as indicated by the arrow 20, the animal feed F is mixed. The flighting 18 includes a first portion generally designated 22 which is disposed helically around the core 12 such that the feed F is urged by the first portion 22 in a direction as indicated by the arrow 28 from the first end 14 towards the second end 16 of the core 12. Additionally, a second portion generally designated 30 is disposed helically around the core 12 such that the feed F is urged by the second portion 30 in the direction 28 from the first end 14 towards the second end 16 of the core 12. Also, the second portion 30 is interposed between the first portion 22.

As shown in FIG. 1, in a second aspect of the present invention, the auger device 10 includes a core 12 having a first end 14 and a second end 16 and flighting 18 which is secured to the core 12 so that in operation of the mixer, when the auger device 10 rotates, the animal feed F is mixed. The flighting 18 includes a first portion 22 which is disposed helically around the core 12 such that the first portion 22 defines a first convolution 24. The first portion 22 also includes at least a part 25 of a second convolution 26 which is disposed consecutively relative to the first convolution 24 so that when the core 12 rotates, the feed F is urged by the first portion 22 in a direction 28 from the first end 14 towards the second end 16 of the core 12. Additionally, the flighting 18 includes a second portion 30 which is disposed helically around the core 12 such that the second portion 30 defines a third convolution 32 and at least a part 33 of a fourth convolution 34 which is disposed consecutively relative to the third convolution 32 so that when the core 12 rotates, the feed F is urged by the second portion 30) in the direction 28 from the first end 14 towards the second end 16 of the core 12. Also, the third convolution 32 is disposed between the first convolution 24 and the at least part 25 of the second convolution 26.

Figure 2:
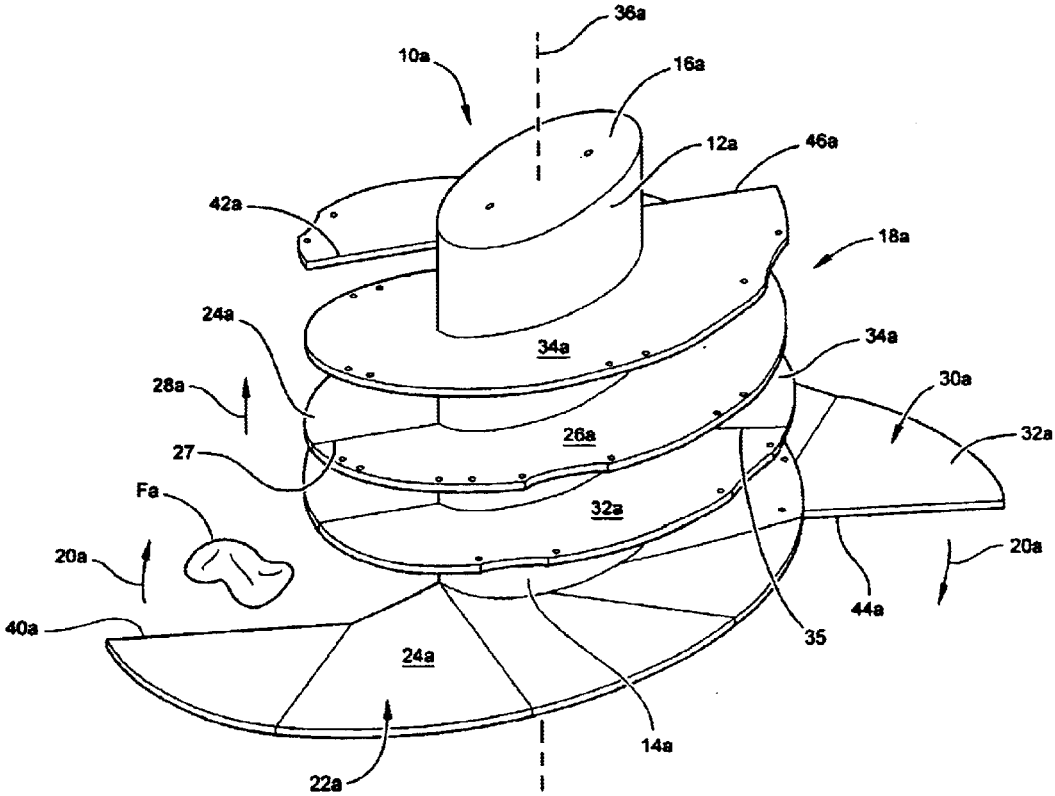
FIG. 2 is a perspective view of an auger device of a vertical mixer according to a third aspect of the present invention.

FIG. 2 is a perspective view of an auger device of a vertical mixer according to a third aspect of the present invention for mixing animal feed. As shown in FIG. 2, an auger device 10*a* includes a core 12*a* having a first and a second end 14*a* and 16*a* respectively. Flighting generally designated 18*a* is secured to the core 12*a* so that in operation of the mixer, when the auger 10*a* rotates as indicated by the arrows 20*a,* the animal feed Fa is mixed. The flighting 18*a* includes a first portion generally designated 22*a* which is disposed helically around the core 12*a* such that the first portion 22*a* defines a first convolution 24*a* and a second convolution 26*a* disposed consecutively relative to the first convolution 24*a* so that when the core 12*a* rotates, the feed Fa is urged by the first portion 22*a* in a direction as indicated by the arrow 28*a* from the first end 14*a* towards the second end 16*a* of the core 12*a*.

A second portion generally designated 30*a* is disposed helically around the core 12*a* such that the second portion 30*a* defines a third convolution 32*a* and a fourth convolution 34*a* is disposed consecutively relative to the third convolution 32*a* so that when the core 12*a* rotates, the feed Fa is urged by the second portion 30*a* in the direction 28*a* from the first end 14*a* towards the second end 16*a* of the core 12*a*. Also, the third convolution 32*a* is disposed between the first convolution 24*a* and second convolution 26*a*.

In a more specific embodiment of the present invention, the core 12*a* rotates about a vertical axis 36*a* and is of cylindrical configuration.

Figure 3:
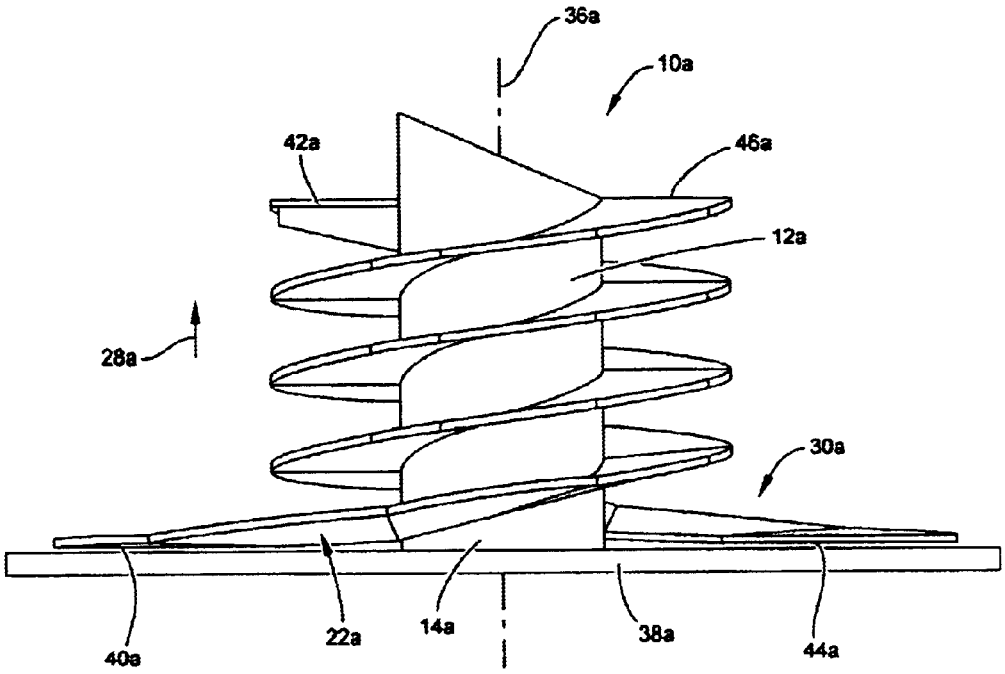
FIG. 3 is a side elevational view of the auger device shown in FIG. 2.

FIG. 3 is a side elevational view of the auger device 10*a* shown in FIG. 2. As shown in FIG. 3, the auger device 10*a* also includes a floor 38*a* which is disposed adjacent to the first end 14*a* of the core 12*a*, the core 12*a* being rotatable relative to the floor 38*a* so that in use of the vertical mixer, the core 12*a* rotates about the vertical axis 36*a* which extends normal, that is perpendicular to the floor 38*a*.

Additionally, as shown in FIG. 2, the first portion 22*a* has a first and a second termination 40*a* and 42*a* respectively, the first termination 40*a* interacting with the floor 38*a* such that when the core 12*a* rotates relative to the floor 38*a*, the first termination 40*a* of the first portion 22*a* sweeps the feed Fa from the floor 38*a* in the direction 28*a* towards the second termination 42*a* and the second end 16*a* of the core 12*a*.

Moreover, the second portion 30*a* has a first and a second extremity 44*a* and 46*a* respectively, the first extremity 44*a* interacting with the floor 38*a* such that when the core 12*a* rotates relative to the floor 38*a*, the first extremity 44*a* of the second portion 30*a* sweeps the feed Fa from the floor 38*a* in the direction 28*a* towards the second extremity 46*a* and the second end 16*a* of the core 12*a*.

Also, the first termination 40*a* of the first portion 22*a* and the first extremity 44*a* of the second portion 30*a* are spaced circumferentially about the vertical axis 36*a* of the core 12*a*.

More particularly, the first termination 40*a* of the first portion 22*a* and the first extremity 44*a* of the second portion 30*a* are spaced diametrically opposite to each other about the vertical axis 36*a* of the core 12*a* as shown in FIGS. 2 and 3.

Furthermore, in a preferred embodiment of the present invention as shown in FIGS. 2 and 3, the second convolution 26*a* follows immediately after the first convolution 24*a* in the direction 28*a* from the first end 14*a* towards the second end 16*a* of the core 12*a*.

Additionally, the fourth convolution 34*a* follows immediately after the third convolution 32*a* in the direction 28*a* from the first end 14*a* towards the second end 16*a* of the core 12*a* as shown in FIGS. 2 and 3.

The arrangement is such that the convolutions 24*a*, 26*a*, 32*a* and 34*a* taken in the direction 28*a* from the first termination 40*a* of the first portion 22*a* follow a sequence of the first convolution 24*a* to the third convolution 32*a*, the third convolution 32*a* to the second convolution 26*a*, the second convolution 26*a* to the fourth convolution 34*a* so that the convolution 32*a* of the second portion 30*a* is interposed between the convolutions 24*a* and 26*a* of the first portion 22*a*.

In the preferred embodiment of the present invention, the first portion 22*a* is disposed helically around the core 12*a* such that the first portion 22*a* defines a first convolution 24*a* and a second convolution 26*a* disposed successively relative to the first convolution 24*a* so that when the core 12*a* rotates, the feed Fa is urged by the first portion 22*a* in the direction 28*a* from the first end 14*a* towards the second end 16*a* of the core 12*a*. It is to be understood by those skilled in the art that the first portion 22*a* could have a first convolution 24*a* or part of a convolution interrupted relative to a second convolution 26*a* or a remaining part of the first convolution 24*a* as taught in co-pending patent application Ser. No. 09/808550 filed Mar. 14, 2001. Also, the second portion 30*a* could have a third convolution 32*a* or part of a convolution interrupted relative to a fourth convolution 34*a* or a remaining part of the third convolution 32*a*. All the subject matter of the aforementioned application Ser. No. 09/808550 is incorporated herein by reference.

Moreover, the second portion 30*a* is disposed helically around the core 12*a* such that the second portion 30*a* defines the third convolution 32*a* and the fourth convolution 34*a* which is disposed successively relative to the third convolution 32*a* so that when the core 12*a* rotates, the feed Fa is urged by the second portion 30*a* in the direction 28*a* from the first end 14*a* towards the second end 16*a* of the core 12*a*.

As shown in FIGS. 2 and 3, the third convolution 32*a* extends from the first extremity 44*a* to 35. Also, the fourth convolution 34*a* extends from 35 to 46*a*. Furthermore, the first convolution 24*a* extends from the first termination 40*a* to 27 and the second convolution 26*a* extends from 27 to 42*a*. Thus, the third convolution 32*a* of the second portion 30*a* is interposed between the first and second convolutions 24*a* and 26*a* respectively of the first portion 22*a*. The arrangement is such that the feed Fa is rapidly moved from the floor 38*a* upwards to the second or top end 16*a* of the core 12*a* by both portions 22*a* and 30*a*.

Figure 4:
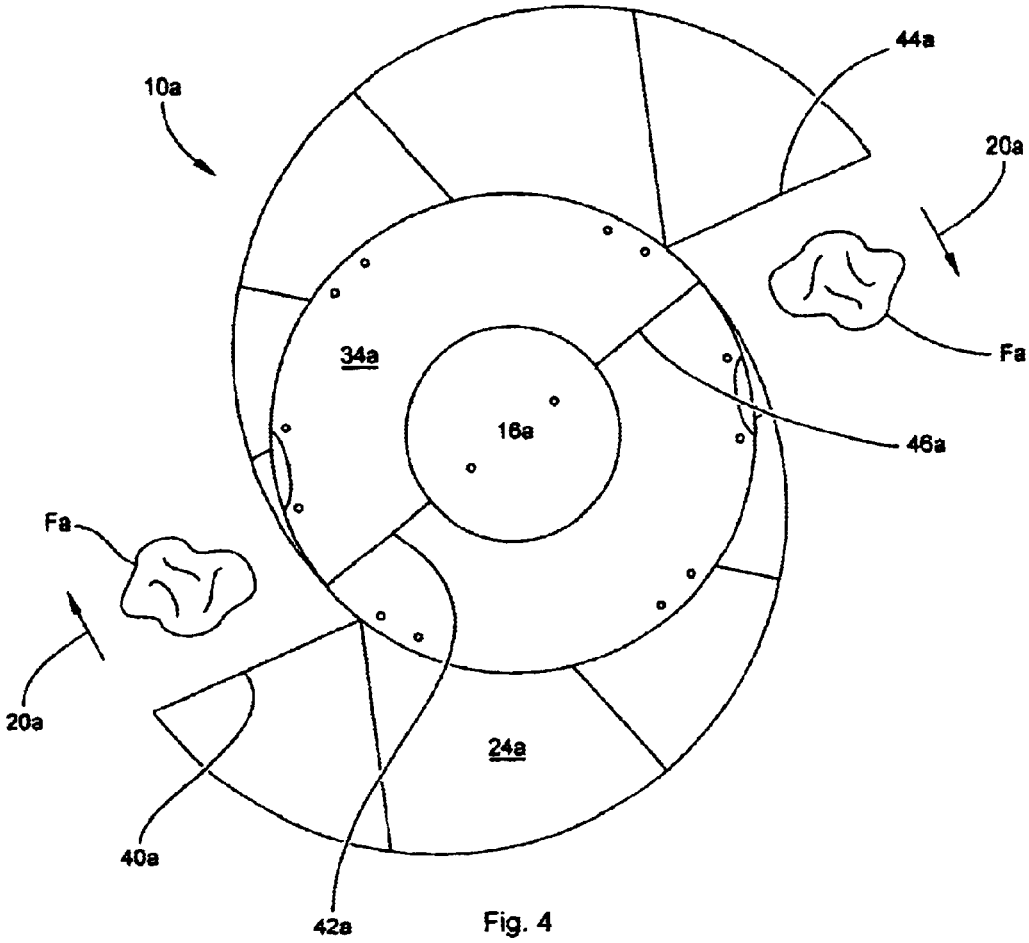
FIG. 4 is a top plan view of the auger device shown in FIGS. 2 and 3.

FIG. 4 is a top plan view of the arrangement shown in FIGS. 2–3. As shown in FIG. 4, the leading edges 40*a* and 44*a* sweep feed Fa into and up the auger device 10*a*.

The arrangement according to the present invention has a distinct advantage over the arrangement in which a single portion conveys the feed from the floor upwards, in that, for a given rate of revolution of the auger device, the load moved from the floor to the second end of the core will be almost doubled.

In operation of the auger device 10*a* of the present invention, a bale of hay or the like is deposited into the mixer and the auger device 10*a* is rotated. As the leading edges 40*a* and 44*a* sweep the floor 38*a*, feed Fa is loaded by the first termination or leading edge 40*a* for conveyance up the helical or spiral path of the first portion 22*a*. Similarly, the leading edge or first extremity 44*a* sweeps a further load of feed for conveyance up the helical path defined by the second portion 30*a* of the flighting 18*a*. The pitch of the combined portions 22*a* and 30*a* is relatively fine so that the void or space between adjacent convolutions such as convolutions 24*a* and 32*a* is easily filled. Also, by the provision of two leading edges 40*a* and 44*a*, such void is more easily loaded. Therefore, for almost the same horsepower requirements of a fine pitch single portion auger, the twin portion flighting auger of the present invention delivers to the top of the auger device almost double the feed.

Therefore, the arrangement according to the present invention, decreases the time required for completing a mixing operation and improves the mixing action of the mixer.

What is claimed is:

1. An auger device of a vertical mixer for mixing animal feed, said auger device comprising:

a core having a first and a second end;

flighting secured to said core so that in operation of the mixer, when the auger device rotates, the animal feed is mixed;

said flighting including;

a first portion disposed helically around said core such that said first portion defines a first convolution and a second convolution disposed consecutively relative to said first convolution so that when said core rotates, the feed is urged by said first portion in a direction from said first towards said second end of said core;

a second portion disposed helically around said core such that said second portion defines a third convolution and a fourth convolution disposed consecutively relative to said third convolution so that when said core rotates, the feed is urged by said second portion in said direction from said first towards said second end of said core;

said third convolution being disposed between said first and second convolutions;

a floor disposed adjacent to said first end of said core, said core being rotatable relative to said floor so that in use of the vertical mixer, said core rotates about a vertical axis extending normal to said said first portion has a first and a second termination, said first termination interacting with said floor such that when said core rotates relative to said floor, said first termination of said first portion sweeps the feed from said floor in said direction towards said second end of said core;

said second portion has a first and a second extremity, said first extremity interacting with said floor such that when said core rotates relative to said floor, said first extremity of said second portion sweeps the feed from said floor in said direction towards said second end of said core;

said first termination of said first portion and said first extremity of said second portion being spaced circumferentially about said vertical axis of said core; and said first termination of said first portion and said first extremity of said second portion are being spaced diametrically opposite to each other about said vertical axis of said core.

2. An auger device as set forth in claim 1 wherein said core is of cylindrical configuration.

3. An auger device as set forth in claim 1 wherein said second convolution follows immediately after said first convolution in said direction from said first towards said second end of said core.

4. An auger device as set forth in claim 1 wherein said fourth convolution follows immediately after said third convolution in said direction from said first towards said second end of said core.

5. An auger device as set forth in claim 1 wherein said convolutions taken in said direction from said first termination of said first portion follow a sequence of said first convolution to said third convolution, said third convolution to said second convolution, said second convolution to said fourth convolution so that said convolutions of said second portion are interposed between said convolutions of said first portion.

6. An auger device as set forth in claim 1 wherein said first portion is disposed helically around said core such that said first portion defines a first convolution and a second convolution disposed successively relative to said first convolution so that when said core rotates, the feed is urged by said first portion in a direction from said first towards said second end of said core;

said second portion is disposed helically around said core such that said second portion defines a third convolution and a fourth convolution disposed successively relative to said third convolution so that when said core rotates, the feed is urged by said second portion in said direction from said first towards said second end of said core.

7. An auger device of a vertical mixer for mixing animal feed, said auger device comprising:

a core having a first and a second end;

flighting secured to said core so that in operation of the mixer, when the auger device rotates, the animal feed is mixed;

said flighting including:

a first portion disposed helically around said core such that said first portion defines a first convolution and a second convolution disposed consecutively relative to said first convolution so that when said core rotates, the feed is urged by said first portion in a direction from said first towards said second end of said core;

a second portion disposed helically around said core such that said second portion defines a third convolution and a fourth convolution disposed consecutively relative to said third convolution so that when said core rotates, the feed is urged by said second portion in said direction from said first towards said second end of said core;

said third convolution being disposed between said first and second convolutions;

said core rotating about a vertical axis;

said core being of cylindrical configuration;

the auger device further including:

a floor disposed adjacent to said first end of said core, said core being rotatable relative to said floor so that in use of the vertical mixer, said core rotates about a vertical axis extending normal to said floor;

said first portion having a first and a second termination, said first termination interacting with said floor such that when said core rotates relative to said floor, said first termination of said first portion sweeps the feed from said floor in said direction towards said second end of said core;

said second portion having a first and a second extremity, said first extremity interacting with said floor such that when said core rotates relative to said floor, said first extremity of said second portion sweeps the feed from said floor in said direction towards said second end of said core;

said first termination of said first portion and said first extremity of said second portion being spaced diametrically opposite to each other about said vertical axis of said core;

said second convolution following immediately after said first convolution in said direction from said first towards said second end of said core;

said fourth convolution following immediately after said third convolution in said direction from said first towards said second end of said core; and said convolutions taken in said direction from said first termination of said first portion following a sequence of said first convolution to said third convolution, said third convolution to said second convolution, said second convolution to said fourth convolution so that said convolutions of said second portion are interposed between said convolutions of said first portion.

* * * * *

UNITED STATES PATENT AND TRADEMARK OFFICE

CERTIFICATE OF CORRECTION

PATENT NO. : 6,817,752 B2
DATED : November 16, 2004
INVENTOR(S) : Corey Tolle

It is certified that error appears in the above-identified patent and that said Letters Patent is hereby corrected as shown below:

Column 7,
Line 34, after "said" add -- floor; --
Line 38, after "portion" follow immediately by recitation -- sweeps the feed from said floor in said direction towards said second end of said core; --
Lines 39-40, delete paragraph "sweeps the feed from said floor in said direction towards said second end of said core;"
Line 51, after "portion" delete "are"

Column 8,
Line 66, after "from" follow immediately by recitation -- said first towards said second end of said core; --
Line 67, delete paragraph "said first towards said second end of said core;"

Signed and Sealed this

Fifteenth Day of March, 2005

JON W. DUDAS
*Director of the United States Patent and Trademark Office*